US011885185B2

(12) United States Patent
Witte et al.

(10) Patent No.: US 11,885,185 B2
(45) Date of Patent: Jan. 30, 2024

(54) SHIFTING INJECTOR FOR IMPROVED STABBING OF COILED TUBING

(71) Applicant: PREMIER COIL SOLUTIONS, INC., Waller, TX (US)

(72) Inventors: M. Brett Witte, Waller, TX (US); Randall Dean Behrens, Sealy, TX (US)

(73) Assignee: PREMIER COIL SOLUTIONS, INC., Waller, TX (US)

( * ) Notice: Subject to any disclaimer, the term of this patent is extended or adjusted under 35 U.S.C. 154(b) by 0 days.

(21) Appl. No.: 17/159,374

(22) Filed: Jan. 27, 2021

(65) Prior Publication Data

US 2021/0270096 A1 Sep. 2, 2021

Related U.S. Application Data

(60) Provisional application No. 62/966,069, filed on Jan. 27, 2020.

(51) Int. Cl.

| | |
|---|---|
| ***E21B 19/22*** | (2006.01) |
| ***E21B 19/08*** | (2006.01) |
| ***E21B 19/00*** | (2006.01) |

(52) U.S. Cl.

CPC ..... *E21B 19/22* (2013.01); *E21B 19/008* (2013.01); *E21B 19/08* (2013.01)

(58) Field of Classification Search

CPC ..... E21B 19/22

See application file for complete search history.

(56) References Cited

U.S. PATENT DOCUMENTS

| | | | | |
|---|---|---|---|---|
| 5,575,332 | A * | 11/1996 | Wasterval, Jr. | E21B 19/22 166/85.1 |
| 6,457,534 | B1 * | 10/2002 | Rolovic | E21B 19/22 242/421.7 |
| 2007/0125551 | A1 * | 6/2007 | Havinga | E21B 15/00 166/77.2 |
| 2012/0103633 | A1 * | 5/2012 | Korach | E21B 19/22 166/385 |
| 2014/0308105 | A1 * | 10/2014 | Soertveit | E21B 19/02 414/592 |
| 2018/0030793 | A1 * | 2/2018 | Behrens | B66C 1/485 |

* cited by examiner

*Primary Examiner* — Giovanna Wright

(74) *Attorney, Agent, or Firm* — Hunton Andrews Kurth LLP

(57) ABSTRACT

The present invention pertains novel coiled tubing units and methods of stabbing. The coiled tubing unit has a tubing reel; a tubing guide operably connected to the tubing reel; and an injector operably connected to the tubing guide. The injector is configured to move toward or away from the tubing reel. This advantageously allows for more convenient, effective, and/or potentially safer stabbing methods to be employed.

8 Claims, 5 Drawing Sheets

SHIFTING INJECTOR FOR IMPROVED STABBING OF COILED TUBING

CROSS-REFERENCE TO RELATED APPLICATIONS

This application claims priority to U.S. Provisional Patent Application No. 62/966,069 filed on Jan. 27, 2020, which is incorporated herein by reference in its entirety.

FIELD OF INVENTION

This invention relates to the application of safer delivery methods for installing and removing tubing from a shifting injector while under tension and may be particularly applicable in the coiled tubing sector of the oil and gas industry.

BACKGROUND AND SUMMARY

Premier Coil Solutions (PCS), 18993 GH Circle, Waller, Tex., USA, is an advanced manufacturer of coiled tubing products. Premier Coil Solutions, herein known as PCS, is a worldwide leader in Engineering and Manufacturing Excellence in the coiled tubing industry.

Coiled tubing was developed in the 1960's. A Coiled Tubing Unit (CTU) is equipped with a string of long continuous metal pipe normally 1"-3.5" in diameter, spooled onto a large reel which is centered on a large trailer, skid, or truck, for deployment using a machine called an injector to, for example, perform well intervention duties. These duties used to be performed by a number of different machines, crews, and units, but now have been combined into a single unit or CTU that is capable of performing tasks that were not possible with one unit 10 years ago. This long continuous pipe or "Tubing" often only has a brief lifecycle, which can be ruined with a single puncture, cut, or other issue. Moreover, the Tubing is usually not as effective once separated and thus it is usually desirable for it to remain in one piece. Tubing generally is no longer useful or not as useful after being deployed or spooled to a footage of approximately 750,000 to 1.5 million running feet. Once the tubing leaves the tubing manufacturing facility the time starts on the lifecycle or amount of total footage deployed and returned to the CTU.

Typically, the tubing is sent down-hole into either an oil or gas well to perform or assist in performing a well service event after which it is usually spooled back on the CTU. Depending on the operation and function of what is performed down-hole, in some cases it may take upwards of 5 or even 10 or more trips of deployment and spooling to complete the action. This repetitive operation gets added into the lifecycle of the pipe, and depending on how actively the unit is used, it will reach the end of its' cycle and the tubing must be removed and re-spooled with new pipe in a matter of one, two, or three months. As the market demands larger well sizes and deeper wells, improvements in coiled tubing deployment are needed to accommodate. That is, CTU's are often equipped with larger size and lengths of tubing, and require larger methods in which to transport, store, and deploy tubing. Advantageously, the methods described herein meet many of the needs of the coiled tubing industry to safely deploy coiled tubing.

DETAILED DESCRIPTION

Figure 1:
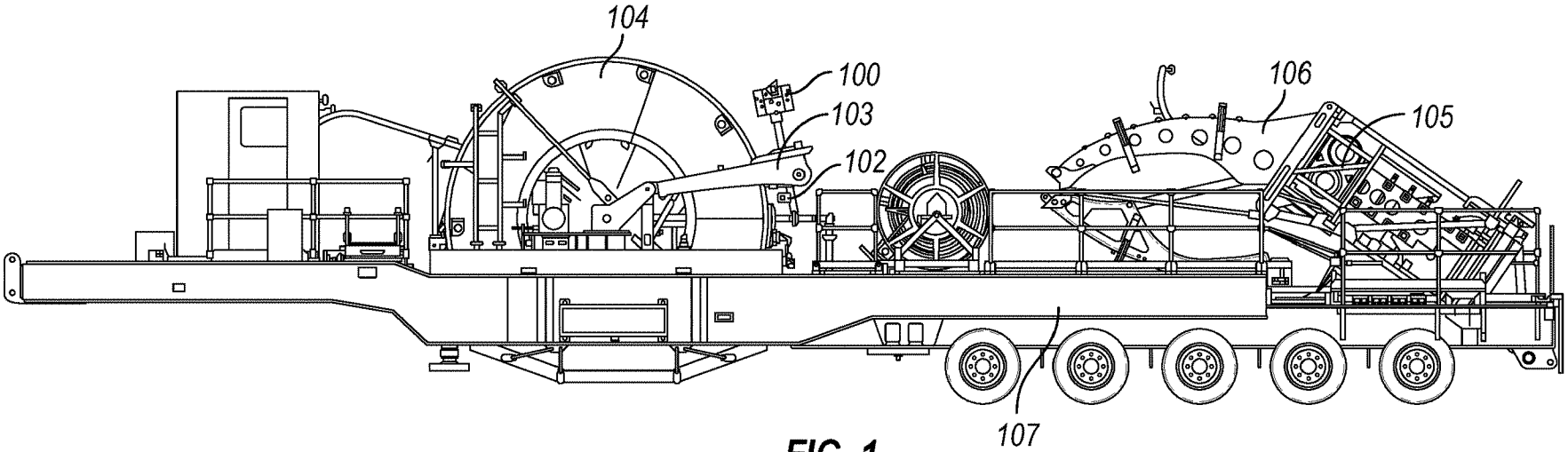
FIGS. 1-7 show various embodiments of coiled tubing units and processes of the present invention.

The methodology of preparing the unit for the impending work usually starts when new tubing is introduced as shown in FIG. 1 onto the tubing reel (104), and is re-routed through the tubing guide (106) into an injector (105) to begin operations. The coiled tubing is typically fed from a tubing reel (104) through a device called a counter (100) which counts the amount of tubing deployed into the wellhead. The counter may be supported by a telescoping rod (102) which can be configured to automatically adjust the height of the counter (100) by force from the height of the levelwind arm (103) which is usually controlled by the operator. The levelwind arm (103) is typically adjusted to provide a precise operating angle in which the tubing is deployed into a bending and straightening mechanism commonly called a tubing guide (106) and into an injector (105) which forces the tubing into the wellhead.

The height of the injector (105) as it lays on the trailer (107) is why the levelwind arm (103) is usually adjusted. That is, the adjustment is part of a method in which the injector is introduced to the tubing by an industry method called "stabbing" of the pipe into the injector.

The stabbing operation may be dangerous due to the fact that spooled tubing is a semi-flexible metal and is under tension. As such, it must be released in a controlled manner to prevent unwanted unwrapping of the spool which could result in lashing tubing which creates a safety hazard. This precise operation combined with the fact that the pipe is typically in an unsupported state mean that the stabbing process should be controlled carefully. A variable that can reduce the stabbing time and associated risk is the distance between the reel and the injector.

Figure 2:
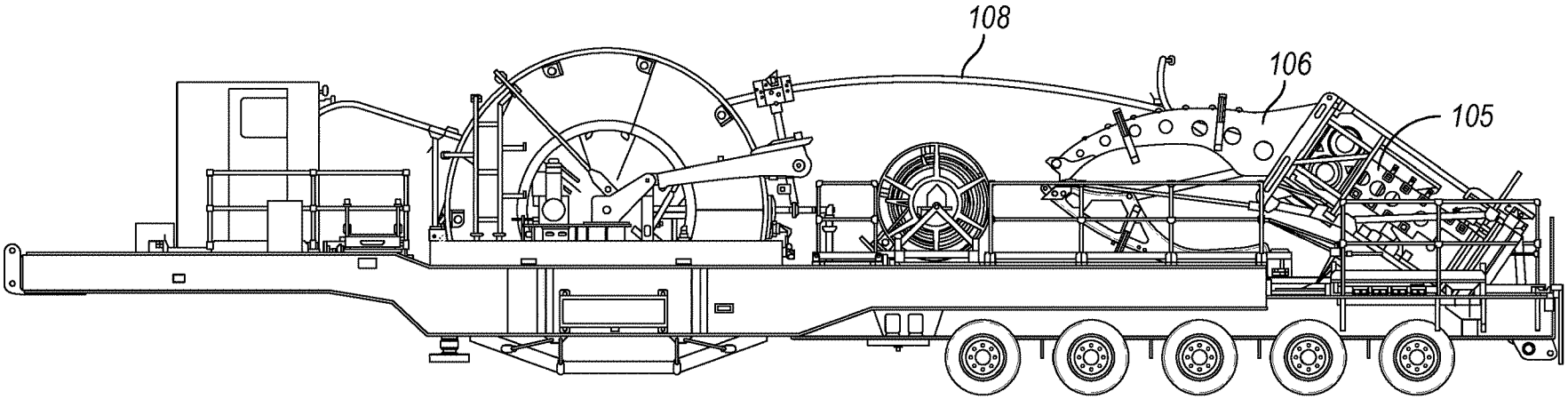

The tubing is typically secured by a clamp near the counter (100) to prevent the tubing from going back through the counter and unspooling. Depending on the length of pipe that the tubing supplier provides on the other side of the counter (injector side 105), trimming the tubing (108) in FIG. 2 is normally required to properly "stab" pipe into the injector. If the tubing (108) is positioned too close to the injector, it is cut to provide a proper sloping angle from the reel into the injector. The sloping or angled cut may also allow less blunt trauma on critical seals on the attachments below the injector (105) towards the wellhead. The reel (104) motor is then turned at an exorbitantly slow rate to allow humans to keep up while providing ample tension to the remaining thousands of feet of spooled tubing. This harmonized effort is completed by attaching a securement device to the tubing while attempting to maintain a safe approach angle to the tensioned reel (104) along the path towards the opening.

Figure 3:
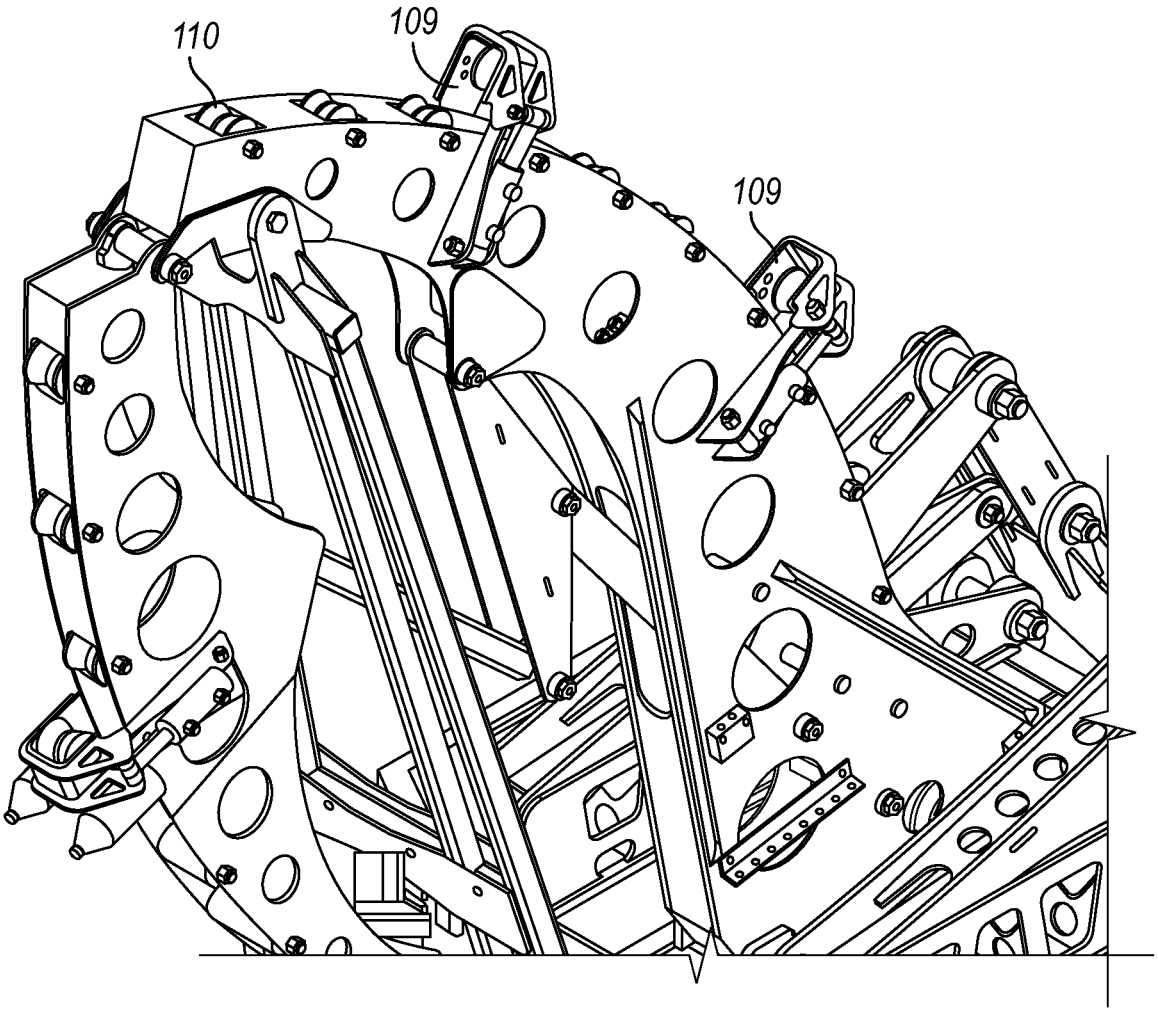

As shown in FIG. 3 the tubing may or may not be pushed by the rollers (110) on the backside of the tubing guide (106). Typically, the distance of the pipe that is needed is estimated by the operator and/or personnel on site.

Figure 4:
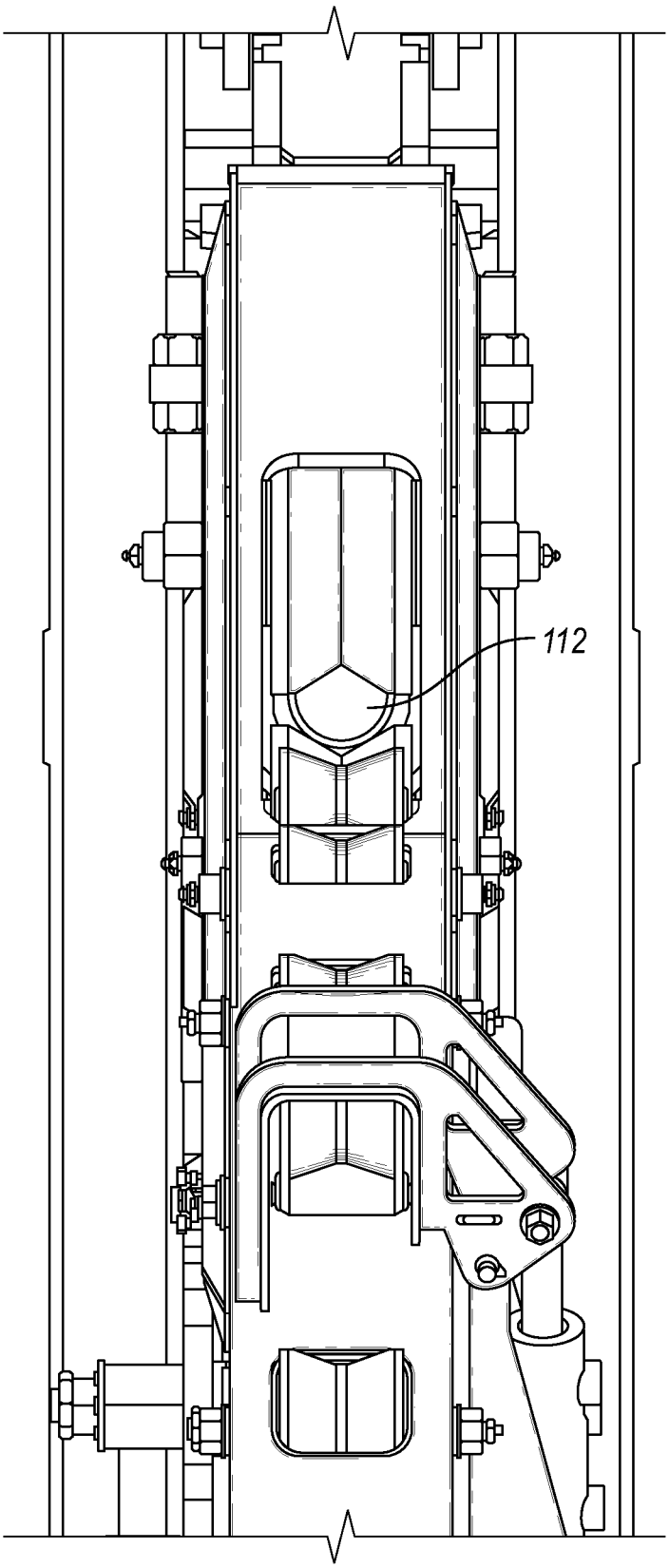

Securement of the spooled reel (104) and tubing (108) remains paramount throughout the "stabbing" procedure. Typically, the less amount of tubing that is deployed, the safer and more efficient the operation becomes. The tubing is forced down by gravity and the natural curve of the tubing, so the levelwind arm (103) must initially be positioned somewhat high and then gradually lowered toward the end of the stabbing process. Thus, the tubing position generally varies in the up and down direction while the tubing (108) is positioned into the hole in the injector (112) shown in FIG. 4. Once the tubing is inside the injector, the injector is powered up, and the tubing is pulled by the injector down the center between two counter-rotating chains.

Figure 5:
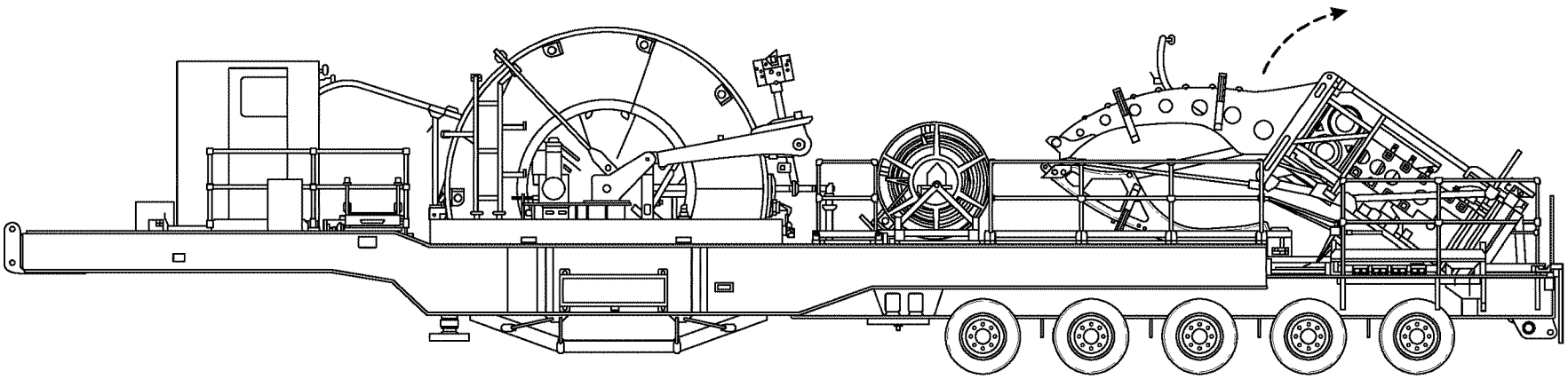

Sometimes the tubing is cut too short or the angled cut is not suitable for the tubing to be placed into the injector. In such cases often a crane or other device is employed to change the angle of the pipe, and this may further add to the potential for harm to personnel or equipment. In cases when the angles are not correct or suitable as shown in FIG. 5 the injector may be tilted up to change the angle of the tubing (108). It would be desirable if other methods or systems were able to assist in changing the tubing angle.

Figure 6:
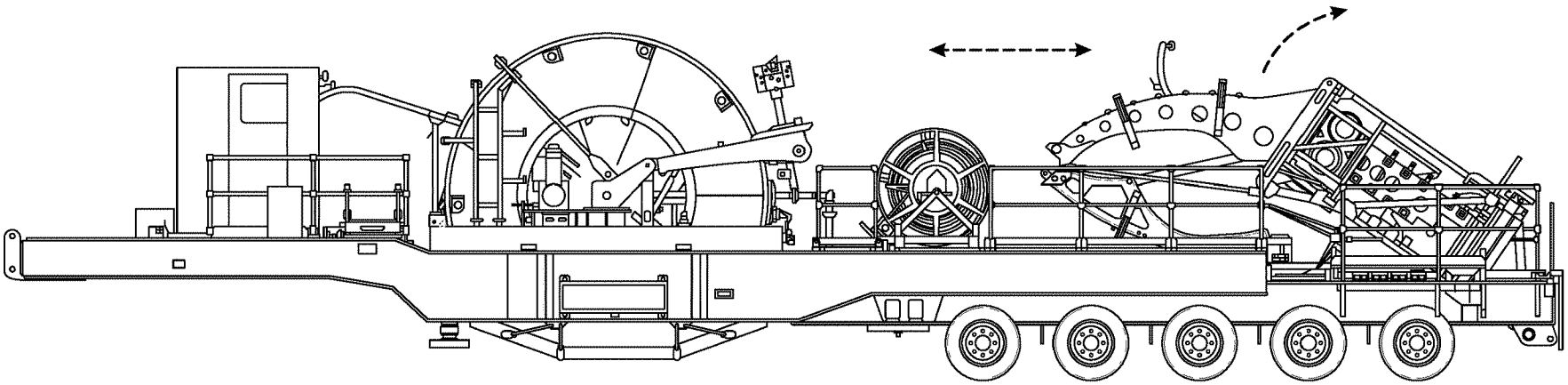

As shown in FIG. 6 the present invention allows further injector movement. First, this may advantageously reduce the time and distance typically required for stabbing operations. Second, the present invention may use mechanical forces instead of or in addition to human power. Either or both of these may advantageously contribute to reducing potential harm to equipment and/or personnel.

Embodiments described herein may permit movement of the injector on any axis relative to the tubing reel, i.e., vertical (up and down), horizontal (forward and backward), and tilted relative to any of the cardinal directions or axes. In other embodiments, the top of the injector (into which coiled tubing is being stabbed) may be permitted to be tilted forward, backward, or to either side at the top while not moving the bottom of the injector, thereby permitting an operator to incrementally move and "work" the injector into a position to as required to safely and efficiently stab it with coiled tubing.

The present inventions not only allow for vertical movement of the injector from the transport position but in one embodiment may also allow for movement of the injector toward or away from the tubing reel to further facilitate the stabbing process. In one embodiment the injector is positioned fully rearward at the start of stabbing operations. The injector can then be positioned 2, 3, or 4 feet or more forward depending on the need. The injector can also be positioned rearward at any time, up to a mechanical stop. These movements can be performed in any convenient and coordinated manner. In one embodiment the movements are conducted remotely through the application of a valve or other remotely located "control" device keeping an operator away from the moving equipment and coiled tubing during the stabbing process.

Figure 7:
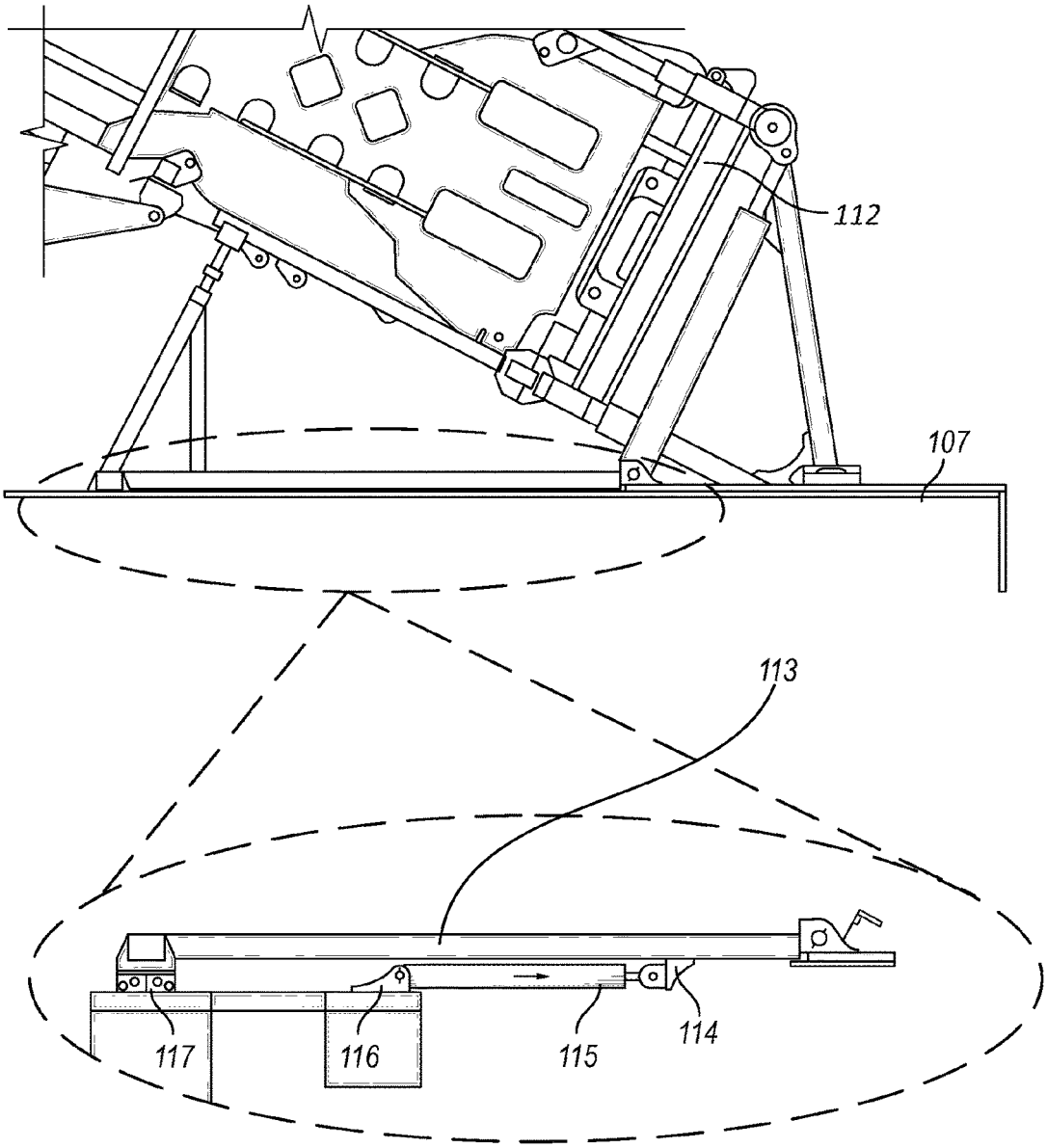

In one embodiment the shift toward or away from the tubing reel may be conducted using hydraulic forces, actuated for a shift, and it can be extended to greater lengths. As shown in one embodiment in FIG. 7, hydraulic pressure may be actuated by a control valve or other mechanism that releases fluid to extend a piston of a hydraulic cylinder or cylinders (115) that are affixed in a convenient manner to a frame component which is affixed to a secure mount (116) of the trailer (107). The piston may be attached by a pinned method or other method such that a secure mount (114) can be affixed to a injector cradle (117) or a framework (113) supporting the injector (112). When the hydraulic cylinder actuates, it forces the shifting of the injector (112) and the cradle (117) components. The shifting may be isolated to a single or multiple contact points on the cradle (117) which allows mount points (116 and 114) to shift towards the rear of the trailer (107) until actuation is no longer needed or the hydraulic cylinder reaches a stopping point.

While the embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. Accordingly, the scope of protection is not limited by the description set out above, but is only limited by the claims which follow, that scope including all equivalents of the subject matter of the claims. The appended drawings illustrate only typical embodiments of the disclosed methods and systems and therefore are not to be considered limiting of its scope and breadth.

What is claimed is:

1. A method of stabbing coiled tubing from a coiled tubing unit comprising:

providing coiled tubing from a tubing reel to a tubing guide through an adjustable levelwind arm operably connected to the tubing guide wherein the levelwind arm is configured to adjust an operating angle at which tubing is deployed from the tubing reel into the tubing guide;

moving the coiled tubing from the tubing guide into an injector wherein the injector is moved toward or away from the tubing reel while moving the coiled tubing into the injector; and providing a trailer wherein the injector lays on the trailer.

2. The method of claim 1, wherein the injector is moved upward or downward in relation to the tubing reel while moving the coiled tubing into the injector.

3. The method of claim 1, wherein the injector is moved in any direction relative to the tubing reel while moving the coiled tubing into the injector.

4. The method of claim 1, further comprising providing a counter to count amount of tubing deployed into a wellhead.

5. The method of claim 1, wherein an angle of the coiled tubing relative to the injector is changed in the absence of a crane.

6. The method of claim 1, wherein an angle of the coiled tubing relative to the injector is changed in the absence of tilting the injector.

7. The method of claim 1, further comprising gradually lowering the levelwind arm while moving the coiled tubing from the tubing guide into the injector.

8. The method of claim 1, wherein the injector is moved upward or downward in relation to the tubing reel and moved toward or away from the tubing reel while moving the coiled tubing into the injector.

* * * * *